United States Patent [19]

Shahan

[11] 4,211,046

[45] Jul. 8, 1980

[54] ACOUSTICAL PANEL MOUNTING ELEMENT

[75] Inventor: James E. Shahan, Chicago, Ill.

[73] Assignee: Transco, Inc., Chicago, Ill.

[21] Appl. No.: 824,826

[22] Filed: Aug. 15, 1977

[30] Foreign Application Priority Data

Sep. 21, 1977 [DE] Fed. Rep. of Germany ..... 2742466

[51] Int. Cl.[2] ..... E04B 1/38

[52] U.S. Cl. ..... 52/506; 248/613

[58] Field of Search ..... 52/617, 506; 248/358 R

[56] References Cited

U.S. PATENT DOCUMENTS

| | | | |
|---|---|---|---|
| 2,706,126 | 4/1955 | Thiry | 248/358 R X |
| 2,716,566 | 8/1955 | Thiry | 403/228 |
| 2,720,374 | 10/1955 | Hutton | 267/141.4 |
| 3,137,887 | 6/1964 | Mannino et al. | 52/617 X |
| 3,532,319 | 10/1970 | Brown | 267/141.4 |
| 3,975,007 | 8/1976 | Chorkey | 248/358 R X |

*Primary Examiner*—Ernest R. Purser
*Assistant Examiner*—Carl D. Friedman
*Attorney, Agent, or Firm*—Edward C. Threedy

[57] ABSTRACT

An acoustical panel mounting element for isolating the panel through its connection to a supporting structure against vibration and noise transmitted therefrom, with the element providing an outer metallic shell for insertion into a pocket formed in the panel and an inner mounting screw receiving sleeve embedded in an elastomer ring carried within the shell.

1 Claim, 3 Drawing Figures

ACOUSTICAL PANEL MOUNTING ELEMENT

SUMMARY OF THE INVENTION

In constructing a protective covering for nuclear plants, heat generators, water cooling evaporating systems, electrical generating plants, and the like, there is usually required an outer protective structure consisting of insulated panels. These panels normally are not self-supporting and therefore need to be attached to supporting structure which may comprise part of the basic structure to which the panel is associated. It is desired to protect the outer insulated panel against vibration and noise transmitted from the basic structure through the connection between the panel and the structure. The object of the present invention is to accomplish this desired function.

The present invention relates to an acoustical panel mounting element which isolates the panel from its connection to a supporting structure against vibration and noise generated by such supporting structure and transmitted therefrom. The mounting element provides an outer metallic shell which sits into a pocket formed in the acoustical panel and which faces to the exterior side surface thereof, with the shell housing an elastomer ring through which is frictionally projected a mounting sleeve. A connecting element, which may be a screw or bolt, is adapted to pass through the sleeve and be completely metallically isolated from the shell as well as the panel through the presence of the elastomer ring, which will absorb any vibration or noise transmitted through the connecting element to the sleeve when the panel is connected to a supporting structure.

GENERAL DESCRIPTION

The object of this invention is achieved by the structure and arrangement of parts as shown in the accompanying drawings, which illustrate the preferred form of the invention, and in which.

Figure 1:
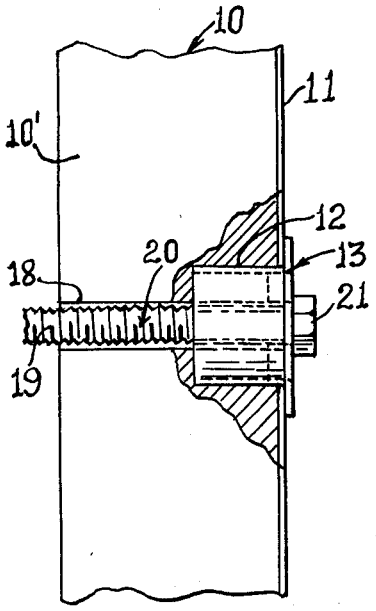
FIG. 1 is a fragmentary side elevational view of the mounting element in place.

Referring to FIG. 1, there is fragmentarily shown an acoustical panel 10 comprising a body of insulating fibrous material 10' and which includes a metallic exterior facing 11. Periodically throughout the panel 10 is formed a recessed pocket 12 opening through the external facing 11. The mounting element 13 is formed to provide a circular body 14 which provides at one end a radially extending collar-forming flange 15. Within the circular body 14 is an elastomer ring 16, and frictionally inserted within the elastomer ring 16 is a metallic sleeve 17.

As viewed in FIG. 1, the mounting element 13 is inserted into the pocket 12 provided by the panel 10. The collar 15 will extend beyond the periphery of the pocket 12 and lie in facial abutment with the adjoining exterior surface of the facing 11.

The panel 10 will be provided with an elongated passage 18 which lies in axial alignment with the sleeve 17. Adapted to be projected through the sleeve 17 as well as the passage 18, is the shank 19 of a connecting element 20. This connecting element 20 may be a screw or bolt and, as such, will provide an enlarged tool-engaging head 21 which is adapted to bear upon one end of the sleeve 17 when the connecting element 20 is used to attach the panel 10 to a suitable supporting structure (not shown).

Figure 2:
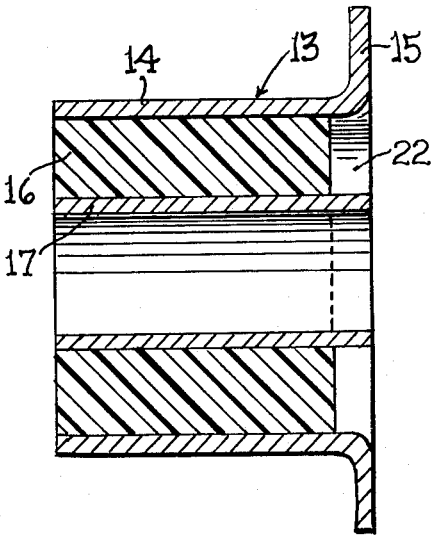
FIG. 2 is a detailed sectional view of the mounting element of this invention.
Figure 3:
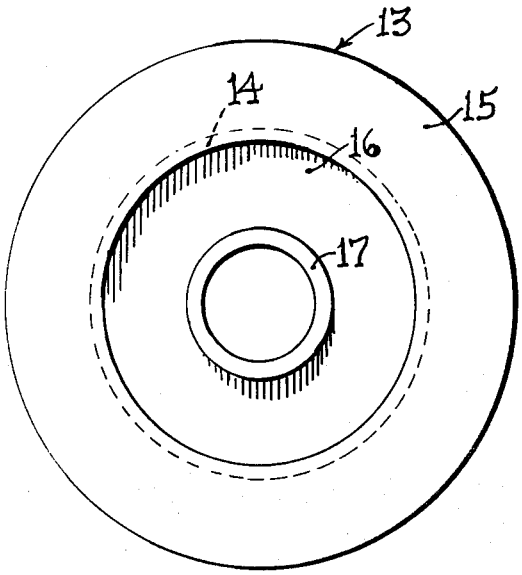
FIG. 3 is a front elevational view of the mounting element.

Referring to FIG. 2, it is noted that the elastomer ring 16 is of a length less than the length of the circular body 14, so that the ring 16 will terminate inwardly of the outer face of the mounting element 13. It should also be noted that the ring 16 is of a length less than the sleeve 17, so that surrounding the exposed face of the sleeve 17 is an air space 22 which projects inwardly of the mounting element 13. It should also be noted that the tool-engaging head 21 of the connecting element 20 is of a size so as to overlap the end of the sleeve 17 and be positioned within the area of the air space 22 so as not to have any metallic contact with the circular body 14 of the mounting element 13 or the metallic exterior face 11 of the panel 10.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. An acoustical panel mounting for isolating the metallic facing of the panel from vibration and noise of its supporting structure with the panel providing a pocket in one wall for the panel mounting and having a passage extending therefrom throughout the width of the panel comprising (a) an outer hollow circular body carried in the pocket formed in the panel and exposed through its metallic facing, (b) a radially extending collar-forming flange formed on one end of said body and adapted to have facial abutment with the metallic facing surrounding the pocket formed therein, (c) a cylindrical connector-receiving inner sleeve within said body and of a length equal to that of said body so as to extend coaxially thereof and of the passage formed through the panel, (d) a ring of resilient material of a size to embrace said inner sleeve and extending inwardly from the other end of said body and terminating short of said collar-forming flange so as to form an air space about one end of said sleeve and to isolate said sleeve from said body and the metallic facing of the panel, and (e) a connector having an enlarged head in contact with said one end of said inner sleeve within the periphery of said body and out of contact with said ring and having an elongated threaded shank freely journalled through said sleeve and the passage formed in said panel for mounting the panel to a supporting structure.

* * * * *

UNITED STATES PATENT AND TRADEMARK OFFICE

CERTIFICATE OF CORRECTION

PATENT NO. : 4,211,046

DATED : July 8, 1980

INVENTOR(S) : James E. Shahan

It is certified that error appears in the above—identified patent and that said Letters Patent is hereby corrected as shown below:

On the cover sheet Item (30) Foreign Priority Data should be deleted.

Signed and Sealed this

*Sixteenth* Day of *September 1980*

[SEAL]

*Attest:*

SIDNEY A. DIAMOND

*Attesting Officer*

*Commissioner of Patents and Trademarks*